US008045915B2

(12) United States Patent
Faber et al.

(10) Patent No.: US 8,045,915 B2
(45) Date of Patent: Oct. 25, 2011

(54) APPARATUS FOR DECURLING AN ADVANCING SHEET, AND A PRINTING DEVICE CONTAINING SUCH AN APPARATUS

(75) Inventors: Pals G. Faber, Arcen (NL); Tom Nagel, Venlo (NL)

(73) Assignee: OCE-Technologies B.V., Venlo (NL)

( * ) Notice: Subject to any disclaimer, the term of this patent is extended or adjusted under 35 U.S.C. 154(b) by 770 days.

(21) Appl. No.: 11/709,166

(22) Filed: Feb. 22, 2007

(65) Prior Publication Data

US 2007/0201924 A1 Aug. 30, 2007

(30) Foreign Application Priority Data

Feb. 23, 2006 (EP) ..... 06110313

(51) Int. Cl.
*B65H 29/70* (2006.01)
*B65H 23/34* (2006.01)

(52) U.S. Cl. ..... 399/406

(58) Field of Classification Search ..... 399/406; 271/188; *B65H 29/70, 23/34*
See application file for complete search history.

(56) References Cited

U.S. PATENT DOCUMENTS

| | | | |
|---|---|---|---|
| 5,202,737 | A | 4/1993 | Hollar |
| 5,539,511 | A | 7/1996 | Wenthe, Jr. et al. |
| 2001/0024013 | A1 | 9/2001 | Horikoshi et al. |

FOREIGN PATENT DOCUMENTS

| | | | | |
|---|---|---|---|---|
| JP | 60-31464 | A | | 2/1985 |
| JP | 09030709 | A | * | 2/1997 |
| JP | 2001261211 | A | * | 9/2001 |

* cited by examiner

*Primary Examiner* — Judy Nguyen
*Assistant Examiner* — Jennifer Simmons
(74) *Attorney, Agent, or Firm* — Birch, Stewart, Kolasch & Birch, LLP

(57) ABSTRACT

An apparatus for decurling an advancing sheet, which contains an endless carrying belt, and multiple rollers for guiding said carrying belt, said rollers including a decurling roller, wherein the mutual orientation between the carrying belt and the decurling roller is adjustable. A printing device is also provided to include such a decurling apparatus.

12 Claims, 2 Drawing Sheets

Prior Art

APPARATUS FOR DECURLING AN ADVANCING SHEET, AND A PRINTING DEVICE CONTAINING SUCH AN APPARATUS

This application claims priority from European Patent Application No. 06110313.1 filed on Feb. 23, 2006 in Europe, the entire contents of which is hereby incorporated by reference in its entirety.

BACKGROUND OF THE INVENTION

The present invention relates to an apparatus for decurling an advancing sheet, comprising at least one endless carrying belt, and multiple rollers for guiding the carrying belt, said multiple rollers including a decurling roller, wherein the mutual orientation between the carrying belt and the decurling roller is adjustable. The present invention also relates to a printing device containing such an apparatus.

In (electrophotographic) printing devices, a powder image is formed on a photoconductive member which is subsequently transferred to a sheet of support material. The sheet of support material is then heated to permanently affix the powder image thereto. As the sheet of support material passes through the various processing stations in the printing device, a curl or bend is frequently created therein. Occasionally, this curl or bend may be inherent in the sheet of support material due to the method of manufacture thereof. Frequently, a decurling apparatus is used to reduce paper curl in the process direction, said decurling apparatus commonly containing belts entrained by rollers, wherein one decurling roller is mounted between two fixed rollers, said decurling roller being adjustable with respect to the belt to enable adjustment of the decurling capacity of the decurling apparatus. Adjustment of the mutual orientation of the belt and the adjustable decurling roller, and hence of the decurling capacity of the decurling apparatus, leads to a change of direction of a belt span entrained between the decurling roller and the fixed roller positioned downstream the decurling roller, thereby leading to a change of the discharge direction of the sheets out of the decurling apparatus. However, this change of discharge direction often leads to adverse forced head-on contact of the decurled sheet with a receiving tray, as a result of which the decurling effect of the decurling apparatus is commonly counteracted as an undesired new curl will be induced in the sheet.

SUMMARY OF THE INVENTION

It is an object of the present invention to provide a decurling apparatus whereby sheets can be decurled in an improved manner. This object can be achieved by providing an adjustable roller which is positioned such that at least two rollers of said plurality of rollers are positioned between said adjustable roller and a sheet discharge location downstream of the adjustable roller, and wherein the mutual orientation of the two rollers is substantially fixed. In other words the at least two rollers are the front rollers as viewed from the discharge side (rear side) of the decurling apparatus. By fixing the mutual orientation of the two front rollers, the direction of the belt span entrained by these front rollers is also fixed in a predefined manner, while at the same time preserving the adjustment capacity of the decurling apparatus, as a result of which the discharge of decurled sheets out of the apparatus can be realized in a predefined manner. Furthermore, the mutual orientation between the belt span and a receiving tray can be optimized. By optimizing this orientation decurled sheets can be discharged from the apparatus in a substantially unhindered manner, through which induction of a new curl in the sheets can be prevented. The decurling roller is adapted to cooperate with the belt to decurl an advancing sheet, wherein the decurling roller may be formed by one of the front rollers. By means of the adjustable roller, the contact angle of the endless belt around the decurling roller can be optimised. The receiving tray or any other receiving means preferably comprises a receiving slot, said receiving slot being positioned substantially in line with the belt span defined by the two front rollers. By positioning the belt span of the discharge section of the decurling apparatus substantially in line with the receiving slot of the receiving means, unimpeded discharge of the decurled sheets can take place, whereby substantially end-on contact of the sheets with the receiving means can be prevented, or at least counteracted. Due to the alignment of said belt span with the receiving slot a substantially linear sheet discharge will take place, wherein the sheets will substantially merely be in (low-friction) sliding contact with the receiving means.

In a preferred embodiment, the apparatus of the present invention comprises a mounting structure for mounting at least the two front rollers. By applying a mounting structure or support structure the mutual orientation between the at least two front rollers can be fixed in a relatively simple and efficient manner. Commonly, also other rollers of the decurling apparatus are mounted by the mounting structure. The adjustable roller may be mounted by the mounting structure in a displaceable manner.

Preferably, the two front rollers mutually engage opposite surfaces of the carrying belt. Commonly the front roller positioned closest to the sheet discharge location of the decurling apparatus is adapted to engage an inner surface of the carrying belt, while the other front roller (commonly the decurling roller) is adapted to engage an outer surface of the carrying belt. In this manner stable and reliable entrainment of the carrying belt, and in particular of the belt span entrained between the two front rollers can be obtained, thereby securing a substantially unhindered discharge of decurled sheets. To secure a reliable adjustment of the decurling capacity of the decurling apparatus, the adjustable decurling roller preferably engages an inner surface of the carrying belt. In this manner the two front rollers and the adjustable roller successively engage the surfaces of the carrying belt in an alternating manner.

The present invention also relates to a printing device containing the apparatus for decurling an advancing sheet. Advantages of such an apparatus have been already elucidated above in a comprehensive manner. In a preferred embodiment the printing device comprising a fuser, wherein the apparatus for decurling an advancing sheet is adapted to receive sheets after having left the fuser. As is commonly known a fuser may be part of any type of printing device, regardless of the nature of the image forming process. Examples include but are not limited to electrographic printing devices and inkjet printing devices.

In a preferred embodiment the printing device comprises sheet kind detection means. In order to optimize the sheet bending action performed by the decurling roller by adjusting the force of depression for pushing the decurling roll against the endless belt, it is advantageous to apply sheet kind detection means to detect data on the thickness of the sheet, data concerning the kind of the sheet (ordinary sheet, OHP sheet, etc), data on the image density of the copy, the kind of the copy (color, black and white, et ctc), and/or data on one side copy or both side copies. Commonly, the information gathered by the sheet kind detection means is processed by a control unit which subsequently determines the optimum force of depression of the decurling roller. In an alternative preferred embodiment the optimum orientation of the adjustable roller with respect to the belt is determined upon sheet-kind data stored in a controller of the apparatus. The decurling results are commonly compared with the stored sheet-kind data, upon which the orientation of the adjustable roller may be changed. Moreover, the decurling results may be stored and added to the already stored sheet kind data for future operations of the decurling apparatus according to the present invention to further improve the efficiency of the decurling apparatus.

BRIEF DESCRIPTION OF THE DRAWINGS

The present invention will be illustrated by means of the following non-limitative embodiment, wherein.

DETAILED DESCRIPTION OF THE INVENTION

Figure 1:
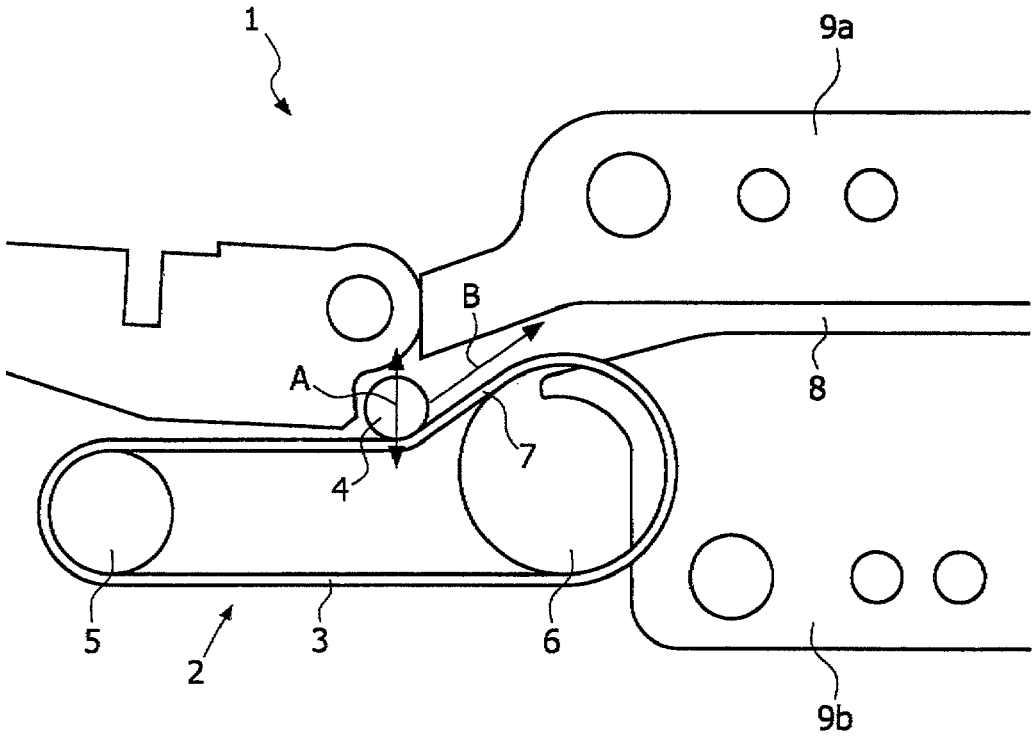
FIG. 1 shows a cross section of a part of a printing device containing a decurling apparatus according to conventional art.

FIG. 1 shows a cross section of a part of a printing device 1 comprising a decurling apparatus 2 for advancing sheets according to conventional art. The known decurling apparatus 2 comprises an endless belt 3 bent greatly inwardly with a depression roll 4 pushed against it, and in this condition a sheet is passed between the belt 3 and the roll 4. The belt 3 is laid over a support shaft 5 and a drive shaft 6 which are positioned with a relatively short distance therebetween. The roll 4 is located between the two shafts 5, 6 to depress the belt 3. In the decurling apparatus 2, the amount of bend of the belt 3 is adjusted by adjusting the amount of protrusion of the roll 4 towards the belt 2 (see arrow A). Consequently, the direction of the belt span 7 entrained by the roll 4 and the drive shaft 6 is also adjusted. A sheet being decurled by the apparatus 2 is discharged from the apparatus 2 by advancing this sheet into a receiving slot 8 defined by an upper guiding plate 9*a* and a lower guiding plate 9*b* mutually spaced apart. During this discharge the sheet will be forced into a head-on contact with the upper guiding plate 9*a* (see arrow B), as a result of which the decurling effect of the apparatus 2 is counteracted as a new curl is induced into this sheet during this contact. The intensity of undesired recurling of the sheet due to the head-on contact with the upper guiding plate 9*a* is substantially dependent on the orientation of the belt span 7 entrained by the roll 4 and the drive shaft 6 with respect to the upper guiding plate 9*a*, and hence on the amount of protrusion of the roll 4 towards the belt 2.

Figure 2:
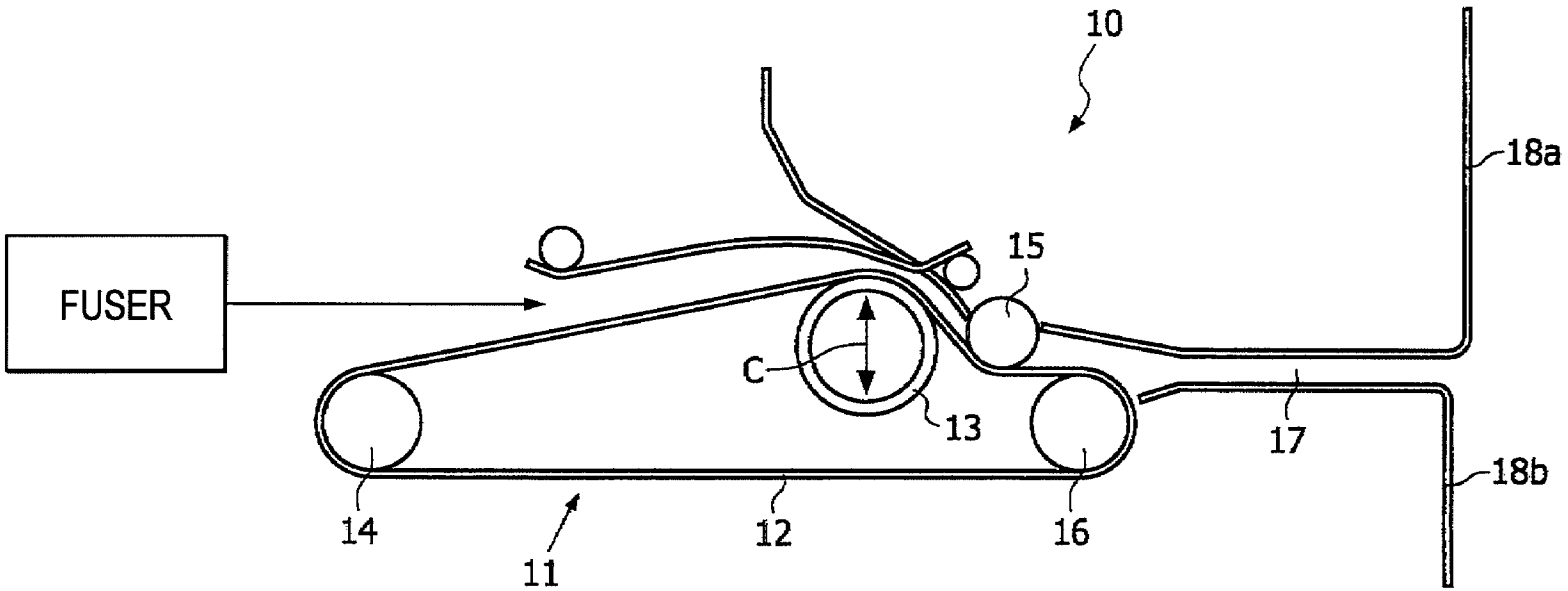
FIG. 2 shows a cross section of a part of a printing device containing a decurling apparatus according to the present invention.

FIG. 2 shows a cross section of a part of a printing device 10 comprising a decurling apparatus 11 for advancing sheets according to the present invention. The apparatus 11 comprises an endless belt 12 bent outwardly by means of a moveable roll 13 pushed against it. The belt 12 is laid over a support shaft 14, a decurler shaft 15, and a driver shaft 16, and under this condition a sheet is passed between the belt 12 and the decurler shaft 15. In the decurling apparatus 11, the amount of bend of the belt 12 is adjusted by adjusting the amount of protrusion of the roll 13 towards the belt 12 (see arrow C). A sheet being decurled by the apparatus 11 is discharged from the apparatus 11 by advancing this sheet into a receiving slot 17 defined by an upper guiding plate 18*a* and a lower guiding plate 18*b* which are mutually spaced apart from each other. Contrary to the apparatus 2 shown in FIG. 1, the roll 13 is located between the support shaft 14 on one side and the decurler shaft 15 and the driver shaft 16 on the other side. Consequently, the orientation of a belt span 19 entrained by the decurler shaft 15 and the driver shaft 16 is fixed and can be optimized with respect to the following receiving slot 17, wherein said belt span 19 is preferably positioned substantially in line with the receiving slot 17 to avoid a head-on contact of an advancing decurled sheet with one of the guiding plates 18*a*, 18*b*. In this manner the introduction of new curls in already decurled sheets can be prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An apparatus for decurling an advancing sheet, comprising:

an endless carrying belt for carrying said advancing sheet, and multiple rollers for guiding the carrying belt, said rollers including a decurling roller and an adjustable roller, the mutual orientation between the carrying belt and said decurling roller being adjustable by displacing said adjustable roller, wherein said adjustable roller is positioned such that at least two rollers of said multiple rollers are positioned between said adjustable roller and a sheet discharge location in a path travelled by the advancing sheet, and wherein the mutual orientation of said at least two rollers is substantially fixed, and wherein said at least two rollers directly contact opposite surfaces of the carrying belt at different points along the path traveled by the advancing sheet.

2. The apparatus according to claim 1, wherein the apparatus includes receiving means for receiving sheets discharged from the carrying belt at the sheet discharge location.

3. The apparatus according to claim 2, wherein the receiving means comprises a receiving slot, said receiving slot being positioned substantially in line with a belt span defined by said at least two rollers.

4. The apparatus according to claim 1, wherein the apparatus includes a mounting structure for mounting said at least two rollers.

5. The apparatus according to claim 1, wherein the decurling roller is one of said at least two rollers.

6. The apparatus according to claim 1, wherein the adjustable roller engages an inner surface of the carrying belt.

7. The apparatus according to claim 1, further comprising a fuser, wherein the apparatus for decurling an advancing sheet is adapted to receive sheets after having left the fuser.

8. A printing device comprising the decurling apparatus according to claim 1.

9. The printing device according to claim 8, further comprising sheet kind detection means.

10. An apparatus for decurling an advancing sheet, comprising:

a single endless carrying belt for carrying said advancing sheet, and multiple rollers for guiding the carrying belt, said rollers including a decurling roller and an adjustable roller, the mutual orientation between the carrying belt and said decurling roller being adjustable by displacing said adjustable roller, wherein said adjustable roller is positioned such that at least two rollers of said multiple rollers and a sheet discharge location are downstream of said adjustable roller, and wherein the mutual orientation of said at least two rollers is substantially fixed, and wherein the at least two rollers contact the belt at different points along the path travelled by the advancing sheet.

11. The apparatus according to claim 10, wherein said at least two rollers contact opposite surfaces of the carrying belt.

12. The apparatus according to claim 10, further comprising a fuser, wherein the apparatus for decurling an advancing sheet is adapted to receive sheets after having left the fuser.

* * * * *